US010957461B2

(12) United States Patent
Kamoshida et al.

(10) Patent No.: US 10,957,461 B2
(45) Date of Patent: Mar. 23, 2021

(54) METHOD FOR PRODUCING MOLTEN AL PLATED STEEL WIRE

(71) Applicant: NISSHIN STEEL CO., LTD., Tokyo (JP)

(72) Inventors: Shinichi Kamoshida, Osaka (JP); Tadaaki Miono, Osaka (JP); Yasunori Hattori, Osaka (JP); Takeshi Shimizu, Tokyo (JP)

(73) Assignee: NIPPON STEEL NISSHIN CO., LTD., Tokyo (JP)

( * ) Notice: Subject to any disclaimer, the term of this patent is extended or adjusted under 35 U.S.C. 154(b) by 148 days.

(21) Appl. No.: 16/214,194

(22) Filed: Dec. 10, 2018

(65) Prior Publication Data

US 2019/0108927 A1 Apr. 11, 2019

Related U.S. Application Data

(63) Continuation of application No. 15/319,461, filed as application No. PCT/JP2014/067766 on Jul. 3, 2014, now abandoned.

(51) Int. Cl.

| | |
|---|---|
| ***C23C 2/12*** | (2006.01) |
| ***H01B 5/08*** | (2006.01) |
| ***C23C 2/38*** | (2006.01) |
| ***C23C 2/14*** | (2006.01) |
| *D07B 1/14* | (2006.01) |

(52) U.S. Cl.

CPC ..... *H01B 5/08* (2013.01); *C23C 2/12* (2013.01); *C23C 2/14* (2013.01); *C23C 2/38* (2013.01); *D07B 1/147* (2013.01); *D07B 2205/3067* (2013.01)

(58) Field of Classification Search

CPC ..... C23C 2/14; C23C 2/12; C23C 2/38

See application file for complete search history.

(56) References Cited

U.S. PATENT DOCUMENTS

2008/0044584 A1* 2/2008 Eriksson ..... C23C 2/003 427/430.1
2009/0208665 A1* 8/2009 Eriksson ..... C23C 2/24 427/547

FOREIGN PATENT DOCUMENTS

| | | |
|---|---|---|
| JP | 08-306246 | 11/1996 |
| JP | 2006-339040 | 12/2006 |
| JP | 2009-179865 | 8/2009 |

(Continued)

OTHER PUBLICATIONS

JP-2011208263-A English translation. (Year: 2020).*

*Primary Examiner* — Hai Y Zhang
(74) *Attorney, Agent, or Firm* — Clark & Brody LP

(57) ABSTRACT

A method of producing an Al plated steel wire comprises a first step of continuously immersing a material steel wire formed of a steel core into a molten Al plating bath and then withdrawing the material steel wire to a gas phase space. The material steel wire plated with a plating metal is brought into contact with a contact member at the plating bath rising portion to produce the Al plated steel wire, the Al plated steel wire having an average diameter $D_A$ (mm) and a minimum diameter $D_{MIN}$ (mm) in the longitudinal direction of the wire satisfying the following expression (1)

$$(D_A-D_{MIN})/D_A \leq 0.10, \quad (1).$$

The Al plated steel wire is then wound.

4 Claims, 4 Drawing Sheets

(56) References Cited

FOREIGN PATENT DOCUMENTS

| | | | | |
|---|---|---|---|---|
| JP | 2009-187912 | | | 8/2009 |
| JP | 2011-208263 | | | 10/2011 |
| JP | 2011208263 | A | * | 10/2011 |
| JP | 2014-040656 | | | 3/2014 |

* cited by examiner

[Fig.1]
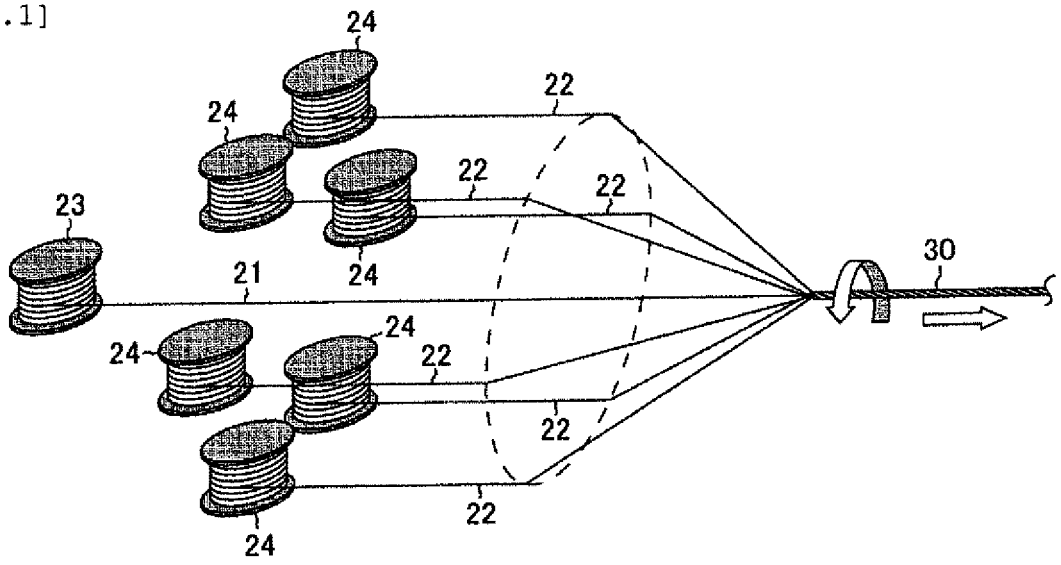
[Fig.2]
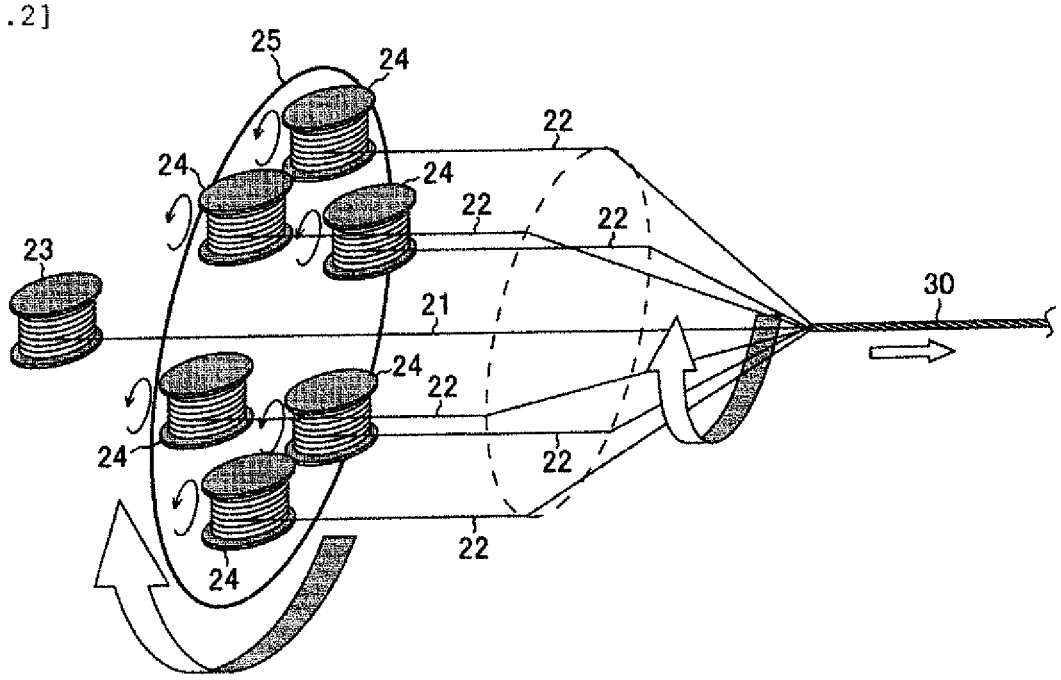

[Fig.3]
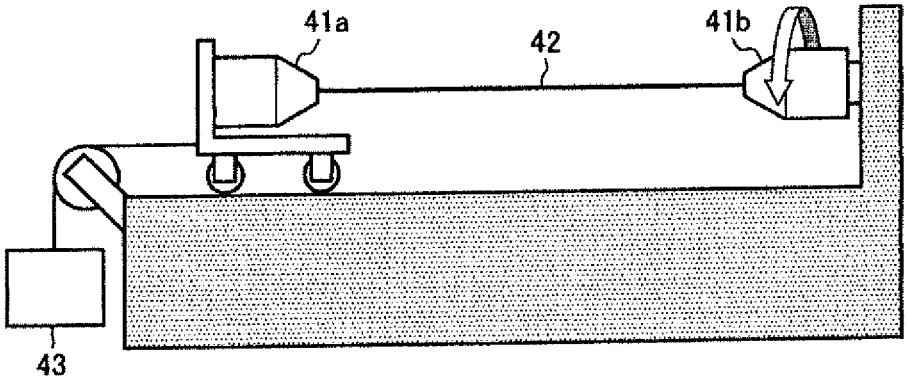
[Fig.4]
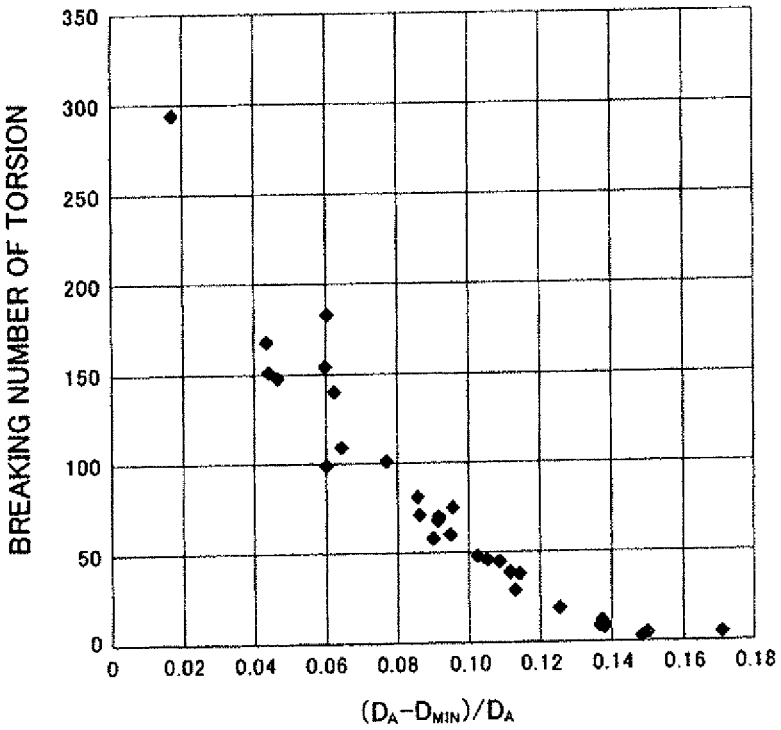

[Fig.5]
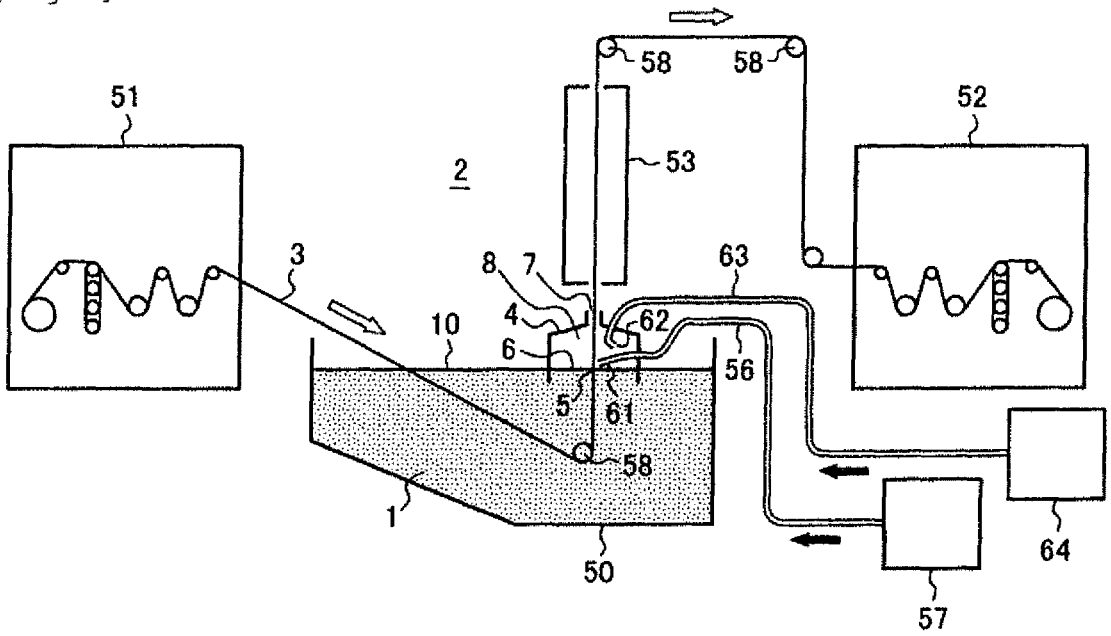
[Fig.6]
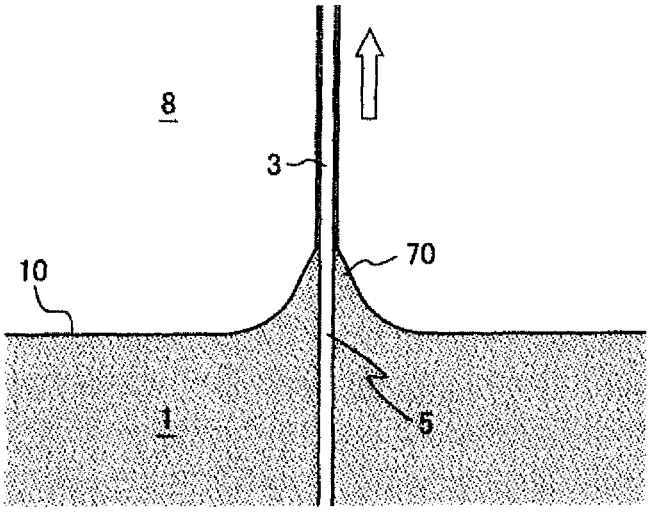

[Fig.7]
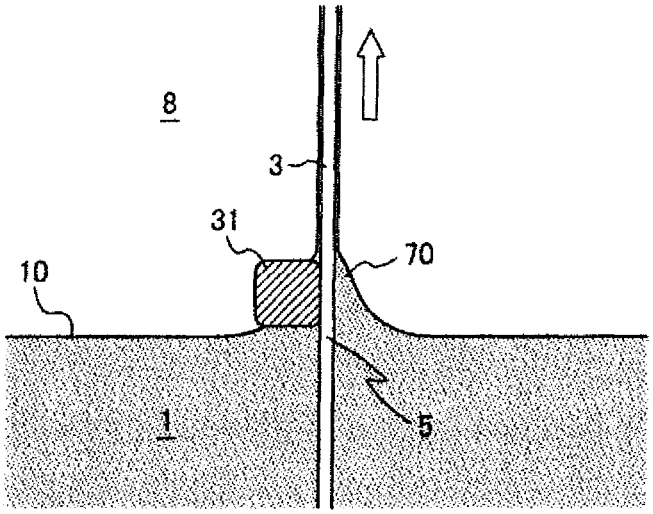

METHOD FOR PRODUCING MOLTEN AL PLATED STEEL WIRE

This application is a Continuation of U.S. Ser. No. 15/319,461 filed on Dec. 16, 2016, which is a national phase of PCT/JP2014/067766 filed on Jul. 3, 2014.

TECHNICAL FIELD

The present invention relates to a molten Al plated steel wire that is improved particularly in resistance to deformation associated with "torsion". The invention also relates to a strand wire containing the molten Al plated steel wire as an element wire.

BACKGROUND ART

A copper wire has been used as various conductive wires including a conductive wire for a wire harness of an automobile. However, contamination with a copper material is not preferred on recycling with iron scrap. Accordingly, from the standpoint of the recycling efficiency, an aluminum wire, which can be melted with iron scrap and has relatively good conductivity, is advantageously applied.

A strand wire is often used as a signal wire or the like used in a wire harness. As a strand wire for a wire harness formed of an aluminum wire, for example, a strand wire containing approximately 10 Al element wires each having a diameter of from 0.25 to 0.30 mm stranded has been subjected to practical use. Although such a large cross sectional area is not necessary from the standpoint of the conductivity for transmitting a signal electric current, an Al element wire is inferior in strength to a Cu element wire and the like, and this level of thickness becomes necessary in consideration of the strength of the strand wire formed only of Al element wires.

As a measure for enhancing the strength of the signal strand wire using Al element wires, it is effective that a steel wire having a larger strength than aluminum is used as a core element wire, around which Al element wires are stranded. The enhancement of the strength of the strand wire enables reduction of the cross sectional area, and lead to reduction in size of a wire harness. As the steel wire for the core element wire, an Al plated steel wire is considered to be promising. The use of an Al plated steel wire avoids bimetallic corrosion, which becomes a problem, for example, in the case using a naked steel wire or a Zn plated steel wire. Furthermore, the material cost is largely decreased as compared to the case using a stainless steel wire.

For the mass production of an Al plated steel wire, a molten Al plating method is effective. It has been considered that it is not easy to form a molten Al plated layer stably on a steel wire having a core wire diameter of 1 mm or less. However, in recent years, molten Al plated steel wires with various depositing amounts can be produced with a continuous line (PTLs 1 to 3).

CITATION LIST

Patent Literatures

PTL 1: JP-A-2009-179865
PTL 2: JP-A-2009-187912
PTL 3: JP-A-2011-208263

SUMMARY OF INVENTION

Technical Problem

A molten Al plated steel wire having a small depositing amount suitable for a signal element wire can be produced by the techniques described in PTL 3 and the like. However, in the case where the conventional molten Al plated steel wire is used as it is as a core element wire of a strand wire, there arises a problem that a phenomenon that the element wire is broken in the production process of the strand wire is liable to occur. It has been clarified that the cause of the phenomenon is that the conventional molten Al plated steel wire has a defect of weakness against a "torsional process".

FIG. 1 conceptually shows an ordinary production method of a strand wire. The figure exemplifies the case where six peripheral element wires 22 are stranded around a core element wire 21. The core element wire 21 and the peripheral element wires 22 are supplied from the supplying bobbins 23 and 24 respectively, and the seven wires are twisted with stranding to provide a strand wire 30. At this time, the element wires each undergo torsion of one revolution per one revolution of the twisting side. This method is of high productivity since a strand wire can be produced by rotating only the wires, and thus is widely applied. However, in the case where a molten Al plated steel wire is used as the core element wire 21, and Al element wires are used as the peripheral element wires 22, a problem is liable to occur by breakage of the center molten Al plated steel wire due to torsion. This prevents a molten Al plated steel wire from being applied to a strand wire.

On the other hand, various techniques for producing a strand wire with no torsion applied to the element wires have been developed and subjected to practical use. FIG. 2 conceptually shows as one example thereof a method for producing a strand wire referred to as a planetary method. In this case, while supplying bobbins 24 of peripheral element wires 22 are disposed on a rotating disk 25, the peripheral element wires 22 are stranded around a core element wire 21 by the rotation of the rotating disk 25, and thereby the core element wire 21 is prevented from being applied with torsion. Furthermore, the supplying bobbins 24 of the peripheral element wires 22 each have a rotation mechanism for rotating on the rotation disk 25, and thereby the peripheral element wires 22 are also simultaneously prevented from being applied with torsion. However, the equipment is expensive due to the complex mechanism and the large number of components, and increases the running cost. Furthermore, the rotation rate is difficult to increase due to the large mass of the rotating components and the like, and thus the productivity is deteriorated. The other methods that prevent element wires from being applied with torsion also have problems in cost and productivity in application thereof to mass production of a signal wire for a wire harness.

An object of the invention is to provide a molten Al plated steel wire excellent in torsional resistance that does not cause the aforementioned problem of breakage due to torsion in application to an ordinary production equipment for a strand wire, in which element wires are applied with torsion.

Solution to Problem

The object is achieved by a molten Al plated steel wire containing a steel core wire having a diameter of from 0.05 to 0.50 mm as a core material, having thereon molten Al plating with a depositing amount thereof that is uniformized to satisfy the following expression (1) for an average diameter $D_A$ (mm) and a minimum diameter $D_{MIN}$ (mm) in the longitudinal direction of the wire:

$$(D_A-D_{MIN})/D_A \leq 0.10 \quad (1)$$

The average diameter $D_A$ (mm) and the minimum diameter $D_{MIN}$ (mm) can be obtained by measuring the wire diameter of one Al plated steel wire for a length L of a portion thereof to be applied continuously to a stranding process. Assuming that the two directions that are orthogonal to each other and each are perpendicular to the longitudinal direction of the wire material are designated as an x direction and a y direction respectively, the average value of the diameter $D_x$ (mm) in the x direction and the diameter $D_y$ (mm) in the y direction at one position in the longitudinal direction, i.e., $(D_x+D_y)/2$, is designated as the wire diameter at the position in the longitudinal direction. The diameters $D_x$ and $D_y$ can be obtained, for example, by a method of measuring the projected diameter on viewing the wire material in one direction by irradiating with laser light. The average diameter $D_A$ and the minimum diameter $D_{MIN}$ are the average value and the minimum value respectively of the wire diameter D within the range of the length L. On obtaining the average diameter $D_A$ and the minimum diameter $D_{MIN}$, the distance between the measurement points adjacent to each other in the longitudinal direction (i.e., the measurement pitch of the wire diameter D) is 0.2 mm or less.

The molten Al plated steel wire having a depositing amount of the molten Al plating that is uniformized is preferably not subjected to a wire drawing process after applying to the molten Al plating.

The material steel wire applied to molten Al plating may be a naked steel wire, and also may be a plated steel wire, such as a Zn plated steel wire and an Ni plated steel wire. In the description herein, the plating that is preliminarily applied to the surface of the material steel wire to be applied to molten Al plating is referred to as "preliminary plating". The "steel core wire" described above means the steel portion occupied on the cross section of the molten Al plated steel wire. In the molten Al plated steel wire that is not subjected to a wire drawing process after applying to the molten Al plating, the diameter of the steel portion constituting the material steel wire applied to molten Al plating corresponds to the diameter of the steel core wire. The thickness of the preliminary plating layer is not included in the diameter of the steel core wire.

The invention also provides a strand wire containing the aforementioned molten Al plated steel wire as an element wire that is stranded with other element wires in a state where the molten Al plated steel wire is applied with torsion. The invention also provides a method for producing a strand wire, containing twisting the aforementioned molten Al plated steel wire with other element wires in a state where the molten Al plated steel wire is applied with torsion.

Advantageous Effects of Invention

The molten Al plated steel wire of the invention is notably improved in resistance to torsion. Accordingly, as an element wire of a strand wire in application thereof to an ordinary method of a wire stranding process with torsion applied thereto, the breakage thereof, which has been a problem, can be avoided. In particular, the wire can be subjected to a wire stranding process with torsion applied thereto without subjecting to a wire drawing process after applying to the molten Al plating, and therefore the use of the wire as a core element wire of a strand wire can enhance the strength of the strand wire at low cost. Accordingly, the invention is useful particularly for achieving both the high strength and the low cost of the strand wire for wire harness.

BRIEF DESCRIPTION OF DRAWINGS

FIG. 1 is an illustration conceptually showing an ordinary production method of a strand wire with torsion applied to element wires.

FIG. 2 is an illustration conceptually showing a production method of a strand wire by a planetary method with no torsion applied to element wires.

FIG. 3 is an illustration schematically showing a structure of a torsional test equipment.

FIG. 4 is a graph showing the relationship between $(D_A-D_{MIN})D_A$ and the breaking number of torsion of the molten Al plated steel wire.

FIG. 5 is an illustration schematically showing an example of a structure of a production equipment of a molten Al plated steel wire.

FIG. 6 is an illustration schematically showing a cross section of a rising portion of a plating bath in parallel to the vertical direction.

FIG. 7 is an illustration schematically showing a cross section of a rising portion of a plating bath in parallel to the vertical direction, in which a contact member is provided.

DESCRIPTION OF EMBODIMENTS

As the molten Al plated steel wire that assumes a role of reinforcing a strand wire for a wire harness, a steel core wire having a diameter in a range of from 0.05 to 0.50 mm is useful. When the steel core wire is too thin, the strength enhancing effect of the strand wire may be small, and when the steel core wire is too thick, not only the strength may be excessive, but also the total diameter of the strand wire may be larger, which is contrary to the needs of a thin wire and a light weight of a wire harness.

According to the investigations made by the present inventors, it has been found that the molten Al plated steel wire having a steel core wire having such a small diameter as above tends to have a wire diameter that is uneven in the longitudinal direction in the production thereof, which is a cause of the reduction of the durability to a "torsional process" (which may be hereinafter referred to as "torsional resistance") in a state untouched after the molten Al plating. However, it has been difficult to find a condition for providing good torsional resistance stably only by evaluating the torsional characteristics with the difference between the maximum diameter and the minimum diameter in the longitudinal direction as the parameter. As a result of the further investigations under the circumstances, it has been clarified that in the fluctuation of the wire diameter in the longitudinal direction, the portion having an increased wire diameter has no particular adverse effect on the torsional resistance of the molten Al plated steel wire. Accordingly, such a parameter is necessarily determined that excludes the effect of the increased wire diameter. As a result of the detailed studies, it has been confirmed that the torsional resistance of the molten Al plated steel wire can be favorably evaluated by the expression $(D_A-D_{MIN})/D_A$, which is a function of the average diameter $D_A$ (mm) and the minimum diameter $D_{MIN}$ (mm) in the longitudinal direction of the molten Al plated steel wire.

As a torsional test method of a wire material, for example, there has been the rule for a hard drawn steel wire in JIS G3521. However, the method targets a material having a wire diameter of 0.70 mm or more, and there is no general standard for evaluating the torsional resistance of a wire material that is thinner than that. Under the circumstances, the inventors referring to the JIS document have investigated the torsional resistance of various molten Al plated steel wires (that are not subjected to a wire drawing process after applying to the Al plating) by using a torsional test equipment shown schematically in FIG. 3. Specifically, a wire material specimen 42 is held with chucks 41*a* and 41*b*, to which a load of 50 g is applied to prevent the wire material specimen from deflecting, and in this state, one chuck 41*b* is rotated to measure the maximum rotation number (integer) until the wire material is broken, which is designated as the breaking number of torsion of the wire material. For example, in the case where the wire material is not broken until the completion of the eleventh rotation but is broken until the completion of the twelfth rotation, the breaking number of torsion is 11. The distance of the chucks is 100 mm. In most cases, the existing strand wire used in a wire harness for an automobile is subjected to a number of torsion of approximately from 5 to 20 per 100 mm. Accordingly, a molten Al plated steel wire that has torsional resistance providing a breaking number of torsion of 50 or more in the torsional test method used herein can be evaluated to have a practical capability capable of avoiding breakage in the case where a strand wire for a wire harness is produced with an ordinary production equipment for a strand wire with torsion applied to element wires. The breaking numbers of torsion of the conventional molten Al plated wires are from several rotations to approximately 15 in many cases for the wire that is not subjected to a wire drawing process after applying to the Al plating.

FIG. 4 exemplifies the relationship between $(D_A-D_{MIN})/D_A$ and the breaking number of torsion by the aforementioned torsional test of the molten Al plated steel wires (that are not subjected to a wire drawing process after applying to the Al plating). The graph shows the data of the examples shown in Table 1 described later. The average diameter $D_A$ herein is a value based on the wire diameter data in the x direction and the y direction measured with a pitch of 0.1 mm over the entire length (approximately 8,000 m) of the molten Al plated steel wire produced under the same production condition. The minimum diameter $D_{MIN}$ is a value based on the wire diameter data measured in the same manner over 100 mm, which is the distance of the chucks, of the specimen that is actually subjected to the torsional test.

It is understood from FIG. 4 that there is a correlative relationship between $(D_A-D_{MIN})/D_A$ and the breaking number of torsion. For ensuring the torsional resistance providing a breaking number of torsion of 50 or more, it suffices that the fluctuation of the wire diameter satisfies the following expression (1).

$$(D_A-D_{MIN})/D_A \leq 0.10 \quad (1)$$

While the minimum diameter $D_{MIN}$ used herein is a value over the distance between the chucks, i.e., 100 mm, as described above, the portion that is most liable to be broken in the production of a strand wire is a portion having the smallest diameter over the entire length in the longitudinal direction. Accordingly, in the case where $D_A$ and $D_{MIN}$ based on the measurement data of the wire diameter over the entire length in the longitudinal direction satisfy the expression (1), it can be evaluated that the molten Al plated steel wire has a capability that is capable of avoiding breakage in the production of a strand wire over the entire length.

The molten Al plated steel wire that satisfies the expression (1) can be produced directly through a molten Al plating process by applying a measure for uniformizing the depositing amount of the Al plating on molten Al plating, without performing a wire drawing process thereafter. For example, it has been confirmed that the molten Al plated steel wire can be produced by the following method.

The molten Al plated steel wire can be produced in such a manner that a material steel wire formed of a steel core wire having a diameter of from 0.05 to 0.50 mm or a material steel wire formed of a plated steel wire containing the steel core wire having on the surface thereof a Zn plated layer or an Ni plated layer having an average thickness of 5 μm or less is immersed in a molten Al plating bath and then continuously withdrawing to a gas phase space.

FIG. 5 schematically shows an example of a structure of a production equipment of a molten Al plated steel wire capable of being applied to practice of the aforementioned production method. A molten Al plating bath 1 is housed in a plating bath tank 50. A steel wire 3 supplied from a supplying device 51 is continuously conveyed in the direction shown by the arrow to pass through the molten Al plating bath 1, and then withdrawn upward in the vertical direction from the bath surface 10 to pass through a gas phase space 8, which is partitioned from the atmospheric environment 2 with a shield 4. The shield 4 has in an upper part thereof an opening 7, through which the steel wire 3 passes. The plated metal on the surface of the steel wire is solidified through the process of withdrawing to provide a molten Al plated steel wire, which is wound by a winding device 52.

FIG. 6 schematically shows the state of the position on the bath surface, at which the steel wire 3 having passed through the molten Al plating bath 1 is withdrawn in the vertical direction from the bath surface 10. The plating bath 1 is raised along with the steel wire 3, whereby a meniscus 70 is formed around the steel wire 3, and in the portion apart from the meniscus 70, the height of the bath surface 10 is retained substantially horizontally. The height is referred to as an "average bath surface height". The position on the bath surface, at which the steel wire 3 is withdrawn, is referred to as a "plating bath rising portion" (5).

In the gas phase space 8 inside the shield 4, a nozzle 61 for blowing an inert gas to the position on the bath surface, at which the steel wire 3 is withdrawn, (i.e., the plating bath rising portion 5) is disposed. The inert gas is supplied to the nozzle 61 from an inert gas supplying device 57 via a pipe line 56. A gas flow rate controlling mechanism (which is not shown in the figure) is provided in the course of the pipe line 56 or inside the inert gas supplying device 57, with which the flow rate of the inert gas discharged from the nozzle 61 can be controlled. The nozzle 61 is adjusted in the inert gas discharge direction to prevent the inert gas discharge stream from the nozzle 61 from striking on the portion of the withdrawn steel wire at a height of 20 mm or more from the average bath height. Accordingly, the inert gas discharged from the nozzle 61 directly strikes a part of the plating bath surface 6 including the plating bath rising portion 5 and a part of the region of the steel wire 3 withdrawn from the plating bath rising portion 5 at a height of less than 20 mm from the average bath height, and thereby the oxygen concentrations in these parts are kept lower. The nozzle 61, the pipe line 56, the inert gas supplying device 57, and the gas flow rate controlling mechanism (which is not shown in the figure) constitute an inert gas supplying system.

Examples of the inert gas include nitrogen gas, argon gas, and helium gas. In the gas phase space 8 inside the shield 4, a pipe line 63 having a discharge port 62 for introducing an oxygen-containing gas, and thereby the oxygen concentration inside the shield 4 is controlled depending on necessity.

The steel wire 3 withdrawn through the gas phase space 8 inside the shield 4 is cooled during the process of withdrawing, and thereby the plated layer is solidified. In the withdrawing process, a cooling device 53 may be provided depending on necessity, with which the steel wire can be forcibly cooled by blowing gas or liquid mist. A heat treatment device may be inserted between the supplying device 51 and the plating bath 1. The heat treatment atmosphere used may be, for example, a reductive gas atmosphere (such as an $H_2$—N2 mixed gas). In the region from the heat treatment device to the position where the wire is immersed in the plating bath 1, a snout for shielding from the air may be provided in some cases. In the case where preliminary plating or wire drawing is performed as a preceding step, the equipment for the preceding step and the plating equipment may be disposed in series to constitute a continuous line.

For uniformizing the depositing amount of the molten Al plating to satisfy the above expression (1) by using the equipment shown in FIG. 5, it is effective to employ, for example, such a measure that a contact member is disposed at the plating bath rising portion, and the withdrawn steel wire 3 is made in contact with the contact member.

FIG. 7 schematically exemplifies the measure. A contact member 31 is provided to be in contact with the steel wire 3 withdrawn in the vertical direction from the plating bath rising portion 5. The contact part of the contact member 31 to the steel wire 3 may be constituted, for example, by a heat resistant cloth. By withdrawing the steel wire 3 while retaining the contact state with the contact member 31, microvibration of the steel wire 3 is suppressed, and thereby the molten Al plated steel wire with less wire diameter fluctuation satisfying the expression (1) can be produced.

The material steel wire subjected to the molten Al plating may be a wire having preliminary plating, such as a Zn plated steel wire and an Ni plated steel wire, as described above. In the case where a naked steel wire having no preliminary plating is subjected to the molten Al plating, it is preferred that the steel wire is subjected to a reductive heat treatment, and then continuously charged in the molten Al plating bath without exposure to the air by passing through a snout. The steel core wire may also be a stainless steel wire depending on necessity, in addition to a steel types having been used as a Zn plated steel wire and an Ni plated steel wire. A stainless steel is an alloy steel containing Cr in an amount of 10% by mass or more. Examples thereof include the stainless steel types of an austenite series, a ferrite series, a martensite series and the like, defined in JIS G4309:2013. Specific examples thereof include a stainless steel where an austenite phase is said to be metastable, such as SUS301 and SUS304, a stable austenitic stainless steel, such as SUS305, SUS310, and SUS316, a ferritic stainless steel, such as SUS405, SUS410, SUS429, SUS430, SUS434, SUS436, SUS444, and SUS447, a martensitic stainless steel, such as SUS403, SUS410, SUS416, SUS420, SUS431, and SUS440, and also include a chromium-nickel-manganese based stainless steel classified into the SUS200 series, but the stainless steel is not limited thereto. The stainless steel that is applied to the core wire is preferably subjected to Ni plating as preliminary plating.

The molten Al plating bath may have a Si content of from 0 to 12% by mass. In other words, a pure Al plating bath having no Si added may be used, and an Al plating bath containing Si in a range of 12% by mass or less may also be used. The addition of Si can suppress the growth of the brittle Fe—Al based alloy layer formed between the steel core wire and the Al plated layer. The addition of Si also lowers the melting point to facilitate the production. However, the increase of the Si content may deteriorate the workability of the Al plated layer itself, and also may lead reduction of the conductivity. Accordingly, in the case where Si is contained in the Al plating bath 1, the content thereof is preferably in a range of 12% by mass or less. The bath may unavoidably have impurity elements, such as Fe, Cr, Ni, Zn, and Cu, mixed therein in some cases.

The depositing amount of the Al plating is preferably from 5 to 50 μm in terms of the average thickness of the molten Al plated layer in the longitudinal direction. When the depositing amount of the Al plating is too small, there is a possibility that the steel base is exposed in the stranding process and a subsequent crimping process or the like, which may be a cause of deterioration of the corrosion resistance. When the depositing amount of the Al plating is excessive, on the other hand, the proportion of the steel core wire in the cross section is relatively lowered, and the strength per unit wire diameter may be lowered.

EXAMPLE

A molten Al plated steel wire was produced by using a production equipment of a molten Al plated steel wire having the structure shown in FIG. 5. The gas phase space, through which the steel wire was withdrawn from the bath surface, was partitioned with the shield, and the oxygen concentration in the gas phase space was made to be 0.1% by volume or less. Production examples where the contact member (see FIG. 7) was provided at the plating bath rising portion, and the steel wire was withdrawn while making into contact with the contact member, and production examples where the steel wire was withdrawn from the bath surface without the use of the contact member were performed. The contact member used contained a stainless steel square bar having a heat resistant cloth wound on the surface thereof. The square bar of the contact member was fixed to the bath tank. The Al plating bath was a pure Al bath or an Al—Si bath having Si added thereto.

The material steel wires subjected to the molten Al plating were a Zn plated steel wire, an Ni plated steel wire, and a naked steel wire, each containing a hard drawn steel wire according to JIS G3560 as the core material. Among these, the Zn plated steel wire was obtained by subjecting a molten Zn plated hard drawn steel wire having a diameter of 1.0 mm to a wire drawing process to make the prescribed diameter. The Ni plated steel wire and the naked steel wire were also adjusted to have the prescribed diameter by a wire drawing process. The thickness of the Zn plating or Ni plating (preliminary plating) of the material core wire can be found by (outer diameter $D_1$ of material core wire—diameter $D_0$ of steel core wire)/2.

The resulting molten Al plated steel wires were measured for the breaking number of torsion by the aforementioned method (chuck distance: 100 mm, load: 50 g) with the torsional test equipment shown in FIG. 3. The results are shown in Table 1. The relationship between $(D_A-D_{MIN})/D_A$ and the breaking number of torsion is shown in FIG. 4.

For the diameters of the resulting molten Al plated steel wires, as described above, the average diameter $D_A$ was a value based on the measurement data of the entire length of approximately from 100 to 8,000 m of the molten Al plated steel wire, and the minimum diameter $D_{MIN}$ was a value based on the measurement data of the chuck distance of 100 mm of the wire material that was actually subjected to the torsional test.

TABLE 1

| | Al plating bath | | Material steel wire | | | | | Resulting Al plated steel wire | | | | |
|---|---|---|---|---|---|---|---|---|---|---|---|---|
| | | | | Steel core wire | Outer | | | Average | Minimum | | | |
| No. | Composition | Bath temperature (° C.) | Kind of preliminary plating | diameter $D_0$ (mm) | diameter $D_1$ (mm) | Reductive treatment | Use of contact member | diameter $D_A$ (mm) | diameter $D_{MIN}$ (mm) | $(D_A-D_{MIN})/D_A$ | Breaking number of torsion | Class |
| 1 | Al | 700 | Zn | 0.067 | 0.07 | no | no | 0.080 | 0.070 | 0.125 | 18 | comparison |
| 2 | Al | 700 | Zn | 0.067 | 0.07 | no | yes | 0.080 | 0.075 | 0.063 | 139 | invention |
| 3 | Al | 700 | Zn | 0.097 | 0.10 | no | no | 0.117 | 0.097 | 0.171 | 5 | comparison |
| 4 | Al | 700 | Zn | 0.097 | 0.10 | no | no | 0.117 | 0.101 | 0.137 | 9 | comparison |
| 5 | Al | 700 | Zn | 0.097 | 0.10 | no | no | 0.117 | 0.105 | 0.103 | 48 | comparison |
| 6 | Al | 700 | Zn | 0.097 | 0.10 | no | yes | 0.117 | 0.108 | 0.077 | 101 | invention |
| 7 | Al | 700 | Zn | 0.097 | 0.10 | no | yes | 0.117 | 0.110 | 0.060 | 154 | invention |
| 8 | Al | 700 | Zn | 0.097 | 0.10 | no | yes | 0.117 | 0.115 | 0.017 | 294 | invention |
| 9 | Al-4% Si | 685 | Zn | 0.097 | 0.10 | no | no | 0.115 | 0.102 | 0.113 | 29 | comparison |
| 10 | Al-4% Si | 685 | Zn | 0.097 | 0.10 | no | yes | 0.115 | 0.104 | 0.096 | 75 | invention |
| 11 | Al-11% Si | 660 | Zn | 0.097 | 0.10 | no | no | 0.116 | 0.100 | 0.138 | 8 | comparison |
| 12 | Al-11% Si | 660 | Zn | 0.097 | 0.10 | no | yes | 0.116 | 0.105 | 0.095 | 60 | invention |
| 13 | Al-11% Si | 660 | Zn | 0.097 | 0.10 | no | yes | 0.116 | 0.109 | 0.060 | 183 | invention |
| 14 | Al | 700 | Zn | 0.196 | 0.20 | no | no | 0.233 | 0.198 | 0.150 | 5 | comparison |
| 15 | Al | 700 | Zn | 0.196 | 0.20 | no | no | 0.233 | 0.201 | 0.137 | 12 | comparison |
| 16 | Al | 700 | Zn | 0.196 | 0.20 | no | no | 0.233 | 0.207 | 0.112 | 39 | comparison |
| 17 | Al | 700 | Zn | 0.196 | 0.20 | no | yes | 0.233 | 0.212 | 0.090 | 58 | invention |
| 18 | Al | 700 | Zn | 0.196 | 0.20 | no | Yes | 0.233 | 0.219 | 0.060 | 99 | invention |
| 19 | Al | 700 | Zn | 0.196 | 0.20 | no | yes | 0.233 | 0.218 | 0.064 | 109 | invention |
| 20 | Al | 700 | no | 0.20 | 0.20 | yes | no | 0.230 | 0.205 | 0.109 | 45 | comparison |
| 21 | Al | 700 | no | 0.20 | 0.20 | yes | yes | 0.230 | 0.220 | 0.043 | 168 | invention |
| 22 | Al | 700 | Ni | 0.196 | 0.20 | no | no | 0.228 | 0.204 | 0.105 | 46 | comparison |
| 23 | Al | 700 | Ni | 0.196 | 0.20 | no | yes | 0.215 | 0.205 | 0.047 | 148 | invention |
| 24 | Al | 700 | Ni | 0.196 | 0.20 | no | yes | 0.227 | 0.217 | 0.044 | 151 | invention |
| 25 | Al | 700 | Ni | 0.196 | 0.20 | yes | yes | 0.240 | 0.218 | 0.092 | 70 | invention |
| 26 | Al | 700 | Zn | 0.294 | 0.30 | no | no | 0.350 | 0.298 | 0.149 | 3 | comparison |
| 27 | Al | 700 | Zn | 0.294 | 0.30 | no | no | 0.350 | 0.310 | 0.114 | 38 | comparison |
| 28 | Al | 700 | Zn | 0.294 | 0.30 | no | yes | 0.350 | 0.318 | 0.091 | 68 | invention |
| 29 | Al | 700 | Zn | 0.294 | 0.30 | no | yes | 0.350 | 0.320 | 0.086 | 81 | invention |
| 30 | Al | 700 | Zn | 0.49 | 0.50 | no | no | 0.580 | 0.500 | 0.138 | 10 | comparison |
| 31 | Al | 700 | Zn | 0.49 | 0.50 | no | yes | 0.580 | 0.530 | 0.086 | 71 | invention |

It was understood from Table 1 that in the case where the steel wire was withdrawn from the bath surface without the use of the contact member, the uniformization of the depositing amount of the molten plating satisfying the expression (1) was not realized. As a result, the torsional resistance was deteriorated.

On the other hand, in the examples of the invention using the contact member, the depositing amount of the molten Al plating was uniformized to satisfy the expression (1). The examples exhibited a breaking number of torsion exceeding 50, and thus evaluated to have torsional resistance capable of resisting to a stranding process with torsion applied thereto in a state untouched after the molten Al plating.

REFERENCE SIGN LIST

1 molten Al plating bath
2 atmospheric environment
3 steel wire
4 shield
5 plating bath rising portion
6 bath surface portion inside shield
7 opening
8 gas phase space
10 bath surface
21 core element wire
22 peripheral element wire
23, 24 supplying bobbin
25 rotating disk
30 strand wire
31 contact member
41*a*, 41*b* chuck
42 wire material specimen
43 weight
50 plating bath tank
51 supplying device
52 winding device
53 cooling device
56 inert gas supplying pipe
57 inert gas supplying device
58 reel
61 inert gas discharge nozzle
62 oxygen-containing gas discharge port
63 oxygen-containing gas supplying pipe
64 oxygen-containing gas supplying device

The invention claimed is:

1. A method of producing an Al plated steel wire comprises:

a step of continuously immersing a material steel wire formed of a steel core into a molten Al plating bath and then withdrawing the material steel wire to a gas phase space;

a step of bringing the material steel wire plated with a plating metal into contact with a contact member at the plating bath rising portion to produce the Al plated steel wire, the Al plated steel wire having an average diameter $D_A$ (mm) and a minimum diameter $D_{MIN}$ (mm) in the longitudinal direction of the Al plated steel wire satisfying the following expression (1)

$$(D_A-D_{MIN})/D_A \leq 0.10 \quad (1);$$

and a step of winding the Al plated steel wire.

2. The method of producing a molten Al plated steel wire according to claim 1, wherein the material steel wire has a diameter of from 0.05 to 0.50 mm.

3. The method of producing a molten Al plated steel wire according to claim 2, wherein the material steel wire has on the surface thereof a Zn plated layer or an Ni plated layer having an average thickness of 5 μm or less.

4. The method of producing a molten Al plated steel wire according to claim 1, wherein the material steel wire has on the surface thereof a Zn plated layer or an Ni plated layer having an average thickness of 5 μm or less.

* * * * *